United States Patent [19]

Larson et al.

[11] Patent Number: 4,901,610

[45] Date of Patent: Feb. 20, 1990

[54] ADJUSTABLE TORQUE CONTROLLING MECHANISM

[75] Inventors: John K. Larson, Arlington Heights; Talmage O. Green, Shaumburg, both of Ill.

[73] Assignee: Precision Instruments, Inc., Des Plaines, Ill.

[21] Appl. No.: 216,000

[22] Filed: Jul. 7, 1988

[51] Int. Cl.[4] ..... B25B 23/157

[52] U.S. Cl. ..... 81/473; 81/474

[58] Field of Search ..... 81/473, 474, 472, 467, 81/475, 476, 477

[56] References Cited

U.S. PATENT DOCUMENTS

| | | | |
|---|---|---|---|
| 2,732,746 | 1/1956 | Livermont | 81/474 |
| 2,820,381 | 1/1958 | White | 81/474 |
| 2,968,979 | 1/1961 | Aijala | 81/474 |
| 3,020,789 | 2/1962 | Etzkorn | 81/474 |
| 4,063,474 | 12/1977 | Klopping | 81/474 |

*Primary Examiner*—Frederick R. Schmidt
*Assistant Examiner*—Lawrence Cruz
*Attorney, Agent, or Firm*—Hill, Van Santen, Steadman & Simpson

[57] ABSTRACT

An ajustable torque controlling mechanism has a drive shaft for driving connection with a member to be driven and a torque releasable clutch connected with the shaft and including a wear resistant torque sensitive ball detent release device and a compression spring rate adjusting arangement including radial arms on the clutch co-acting with generally ellipsoidal control edges carried by the housing surrounding the shaft.

19 Claims, 2 Drawing Sheets

FIG. 3
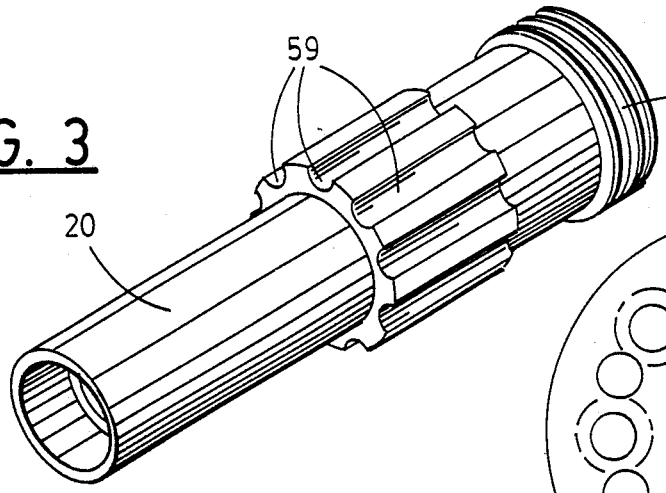
FIG. 5
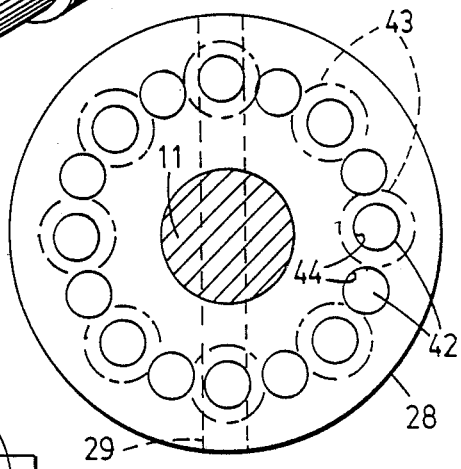
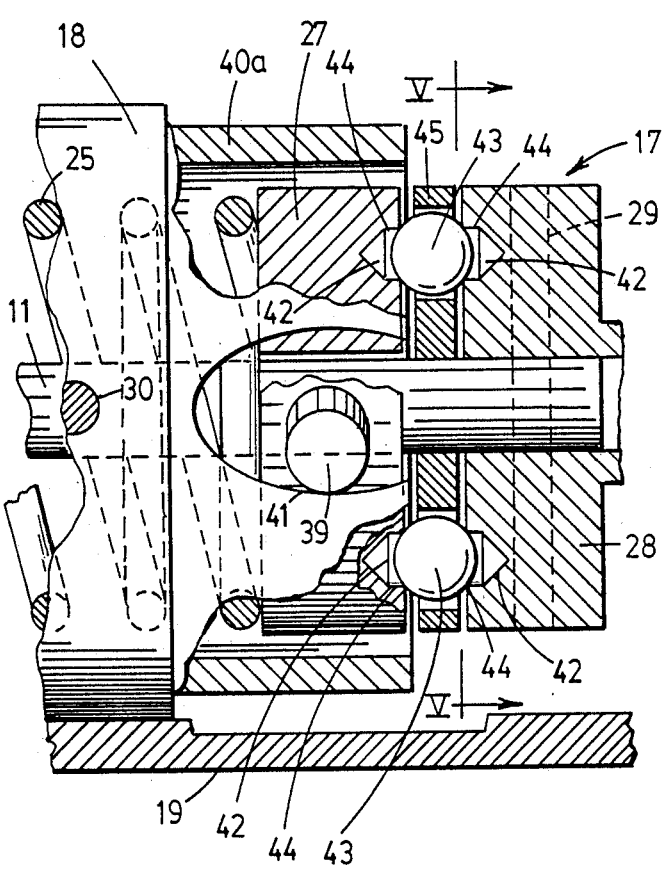
FIG. 4
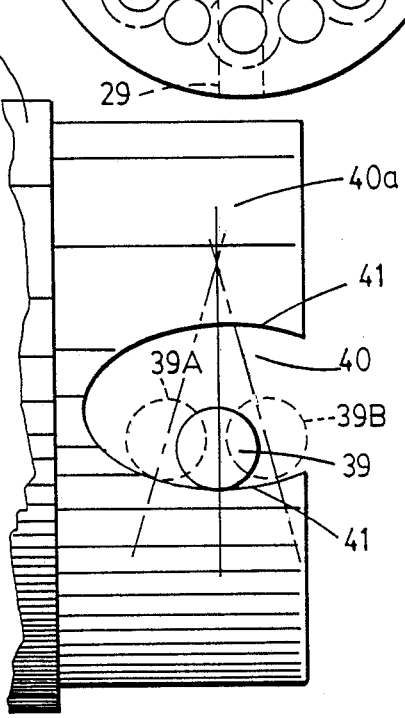
FIG. 6

ADJUSTABLE TORQUE CONTROLLING MECHANISM

BACKGROUND OF THE INVENTION

This inventions relates to mechanisms for limiting the torque applied by driving tools, whether hand operated or power driven, wherein when a predetermined torque load has been attained, there is, in effect, a free wheeling automatic clutch release which avoids excessive torque loads applied to the work. Such mechanisms are useful in hand tools, such as screw drivers and torque wrenches, or as the torque control means in power tools of various types.

Heretofore, these torque controlling or limiting mechanisms have often lacked adequate means for adjusting the release value of the torque release clutch. Where the mechanisms have had adjustment means, there is sometimes a lack of adjustment accuracy. Some devices are unduly liable to maladjustment due to critical wear in use.

SUMMARY OF THE PRESENT INVENTION

An important object of the present invention is to provide a new and improved adjustable torque controlling mechanism which will overcome the disadvantages, drawbacks, inefficiencies, shortcomings, and problems inherent in prior devices of this kind.

In accordance with the present invention there is provided an adjustable torque controlling mechanism comprising any or all of the following features: a drive shaft having one end portion for driving engagement with a member to be driven; a torque releasable clutch on and about an opposite end portion of the shaft and comprising a first disk fixedly attached to the shaft with a terminal part of the shaft exposed at one side of said fixedly attached disk, and a second disk axially shiftable relative to the opposite side of the first disk; wear resistant torque sensitive ball detent release means between the disks; a tubular housing about the shaft including a reaction barrel having a generally cup shaped hand grip member on one end portion of the barrel and enclosing the clutch; a tubular spindle telescopically shiftable within an opposite end portion of the barrel and having a part projecting from the barrel about the shaft and the driving end portion of the shaft projecting from the projecting part of the spindle; means on the projecting part of the spindle to facilitate effecting axial adjustments of the spindle relative to the barrel and including torque value calibrations cooperatively related to index means carried by the projecting part of the spindle; means for fixedly locking the spindle in selectively axially adjusted positions relative to the barrel; spaced antifriction bearing assemblies rotatably mounting the shaft within the spindle, and one of the bearing assemblies located on an end of the spindle within the barrel and having a bearing race facing in spaced relation toward the second clutch disk; a compression spring mounted about the shaft and having one end thrusting against the bearing race and an opposite end thrusting against the second clutch disk; spring rate reaction means coupling the second disk to the barrel; and a calibration screw mounted on the hand grip in coaxial alignment with the second shaft end and having an end connected in axial thrust relation with the second shaft end for effecting a range of selective axial adjustments of the shaft in cooperation with the axially adjusted positions of the spindle for adjusting the compression rate of the spring compression.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

FIG. 3 is a perspective view of the spindle of the assembly in FIGS. 1 and 2;

FIG. 4 enlarged fragmentary sectional detail view taken substantially along the irregular line IV—IV in FIG. 2;

FIG. 5 is a schematic sectional detail view taken substantially along the line V—V in FIG. 4; and FIG. 6 schematic side elevational view of the spring rate reaction means also seen in FIG. 4.

DETAILED DESCRIPTION

Figure 1:
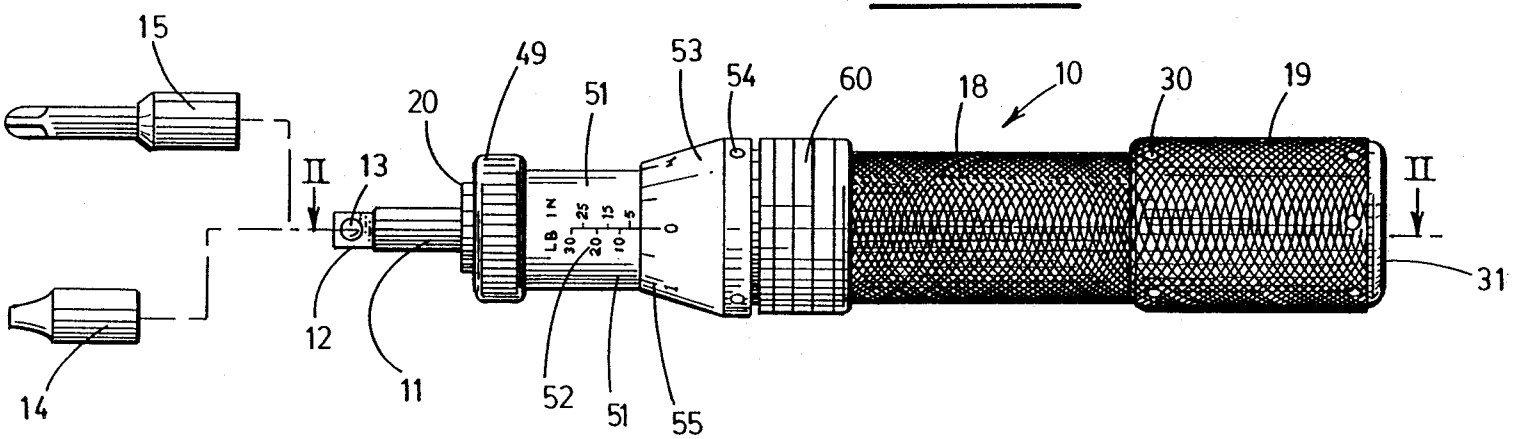
FIG. 1 is a side elevational view of a typical tool assembly embodying the present invention.
Figure 2:
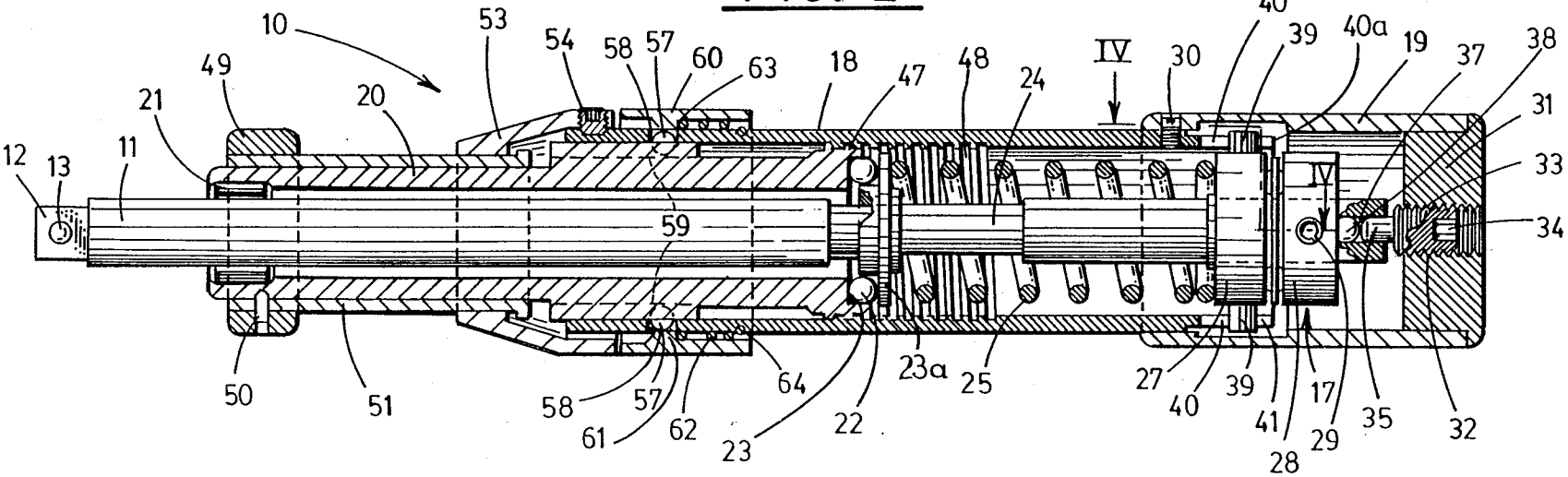
FIG. 2 is an enlarged fragmentary sectional detail view taken substantially along the line II—II in FIG. 1.

Although as earlier indicated herein, the present invention is useful in various tool assemblies, there has been selected for description convenience a screw driver 10 (FIGS. 1 and 2) embodying the adjustable torque controlling mechanism of the present invention. The assembly 10 comprises a drive shaft 11 having one end portion which may be equipped with a square driving tip 12 having a spring biased ball detent 13 by which a selected screw driver tip, or the like, 14 or 15 may be releasably coupled with the driving tip 12.

On an opposite end portion of the shaft 11, there is mounted a torque releasable clutch 17.

About the shaft 11 is a tubular housing including a reaction barrel 18 having a generally cup-shaped hand grip member 19 on one end of the barrel and enclosing the clutch 17. A tubular spindle 20 is telescopicly shiftable within an opposite end portion of the barrel 18 and has a part projecting from the barrel about the shaft 11. The driving end portion of the shaft 11 projects from the projecting part of the spindle 20. An antifriction roller bearing 21 rotatably mounts the outer end portion of the spindle 20 about the shaft 11. A ball bearing assembly 22 carried by a rabbet groove 23*a* in the inner end of the spindle 20 has a race 23*a* axially movable on a reduced diameter portion 24 of the shaft 11. The race 23 provides a thrust shoulder for one end of a compression loading spring 25. The other end of the spring 25 thrusts against a shoulder provided by a disk 27 forming part of the clutch assembly 17. In a preferred construction, the clutch 17 comprises in addition to the thrust shoulder disk 27, which is slidably mounted on the shaft 11, an opposing thrust load disk 28 which is fixedly secured to the shaft as by means of a transverse pin 29. Disk 27 has bore hole large enough so it cannot touch shaft 11, sO no friction can be produced.

In a preferred construction, the hand grip member 19 telescopicly receives the adjacent end portion of the barrel 18 and is desirably secured thereto as by means of pins or set screws 30. A cap 31 of substantial thickness on the hand grip member 19 has a threaded bore 32 coaxial with the shaft 11 and in which bore is received a spring rate calibration screw 33. A combination end thrust and radial stablizing boss 35 on the inner end of the screw 33 fits slidably in a complementary blind end guide bore 37 in which is mounted an antifriction bearing 38 against which the tip of the boss 35 thrusts. This arrangement affords substantial advantages by reason of the quite compact thrust load bearing area. Assuming, in this construction, a full compression thrust load equal to 64 pounds, the small interface area, which may be about 0.040 inch/diameter will have an effective frictional radius of about 0.015 inch. Thus, assuming frictional coefficient of 0.15, total friction from this area with 64 pounds applied equals 0.144 lb/in. If frictional variations equal 20% of the total, then variations equal 0.0288 lb/in, 64 pounds spring pressure equals 30 pounds in output torque so that the friction variation at the interface would equal one part in 1041 or 0.096%. This variation remains proportionally the same at other torque settings.

Substantially radial load is not normal to the operation of the tool. Inadvertent side load might be applied during some applications. The radius of the boss 35 may be about 0.050 inch. Assuming a side load of 5 pounds, and a coefficient of friction equal to 0.15, total friction from the side load would equal 0.0375 lb/in torque. If frictional variations equal 20%, then these variations equal 0.0075 lb/in torque or 0.025% of the torque output when the unit is set to release at 30 lb/in.

For accurate adjustment it is quite desirable, especially where the mechanism is of the incrementally adjustable type as in this instance, as will be further described, to have means for adjusting the spring rate or linearity, other than changing springs or cams, or the like. The spring rate adjustment can also compensate for friction and different angles between ball and detent in the primary release mechanism of the clutch 17. According to the present invention, there is a spring rate reaction means coupling the clutch disk 27 to the adjacent end of the barrel 18. For this purpose, the disk 27 has extending oppositely diametrically therefrom reaction arms 39 which extend into respective openings 40 in a tubular extension **40*a* on the barrel 18 projecting into the hand grip member 19 about the disk 27. As best seen in FIGS. 4 and 6, the openings 40 have spaced generally ellipsoidal bearing surfaces 41 which are respectively engagable by the arms 39** depending on which rotary direction the tool is caused to drive at any given time.

The full line position of the arms 39 is what may be identified as located at the primary release angle of the clutch 17. In this position of the arms 39, which is at substantially the centers of the ellipsoidal edges 41, and assuming the primary release angle is forty-five degrees, a full forty-five degree angle of interference must be overcome to effect clutch release against the pressure of the spring 25. If it is desired to increase the reaction pressure of the spring, adjustment effected by means of the screw 33 is adapted to cause axial shifting of the shaft 11 and move the arms 39 into position **39*a*, which for purpose of description may be assumed to be fifteen degrees away from the center position shown in full outline. The new reaction angle of fifteen degrees in this position is added to the forty-five degree primary release angle resulting in sixty degrees which greatly increases the torque release value. Moving the reaction arms 39 to an opposite position 39*b***, which is fifteen degrees from the forty-five degree primary release angle, results in a thirty degree effective ramp angle. This greatly reduces the torque release value.

It will be understood, of course, that the fifteen degree respective opposite positions of the arms 39 from the primary 45 degree release angle are merely representative and that an incremental range between the two extremes will attain proportionate changes in spring rate adjustment.

A unique wear resistant ball release detent arrangement is provided in the clutch 17. For this purpose, each of the disks 27 and 28 has in its interface matching identical detent ball sockets 42 which clutch detent balls 43 engage. Each of the sockets 42 has a generally cylindrical bore surface 44 of substantial length and of a diameter such that a ball arc of substantially smaller diameter than the associated ball 43 is received in the mouth end of the bore. In a preferred arrangement, there are twice as many of the sockets 42 as there are detent balls 43. For example, there may be sixteen of the sockets 42 and eight of the balls 43, with a ball retaining ring 45 maintaining the balls equally circularly spaced. In each torque release, the balls 43 are permitted full roll action with no friction producing confinement. Longevity of the clutch 17 is substantially increased because as slight wear occurs, during longterm field usage, at the mouth ends of the socket walls 44, there is constant axial takeup so that the ball clutch release mechanism remains substantially uniformly effective throughout the life of the instrument.

Micrometer torque value adjustment is effected by means of the spindle 20 which is threadedly engaged within the barrel 18. For this purpose, the inner end portion of the spindle 20 has formed thereon buttress external threads 47 (FIGS. 2 and 3) which engage threadedly with complementary internal buttress threads 48 on the barrel 18. By turning the spindle 20 to run it inwardly or outwardly causes corresponding increase or decrease in the thrust value of the spring 25. Turning of the spindle is facilited by means of an adjusting ring grip 49 on the outer end portion of the spindle 20 and which may be secured thereto by means of pins 50 which also extend through and secure to the spindle an indicia tube 51 carrying a micrometer scale 52 calibrated in a desirable range of torque release values. A thimble 53 fixedly secured as by means of one or more set screws 54 to the adjacent end portion of the barrel 18 carries gauge markings 55 cooperatively related to the indicia 52 on the indicia tube 51.

In any rotary adjusted position of the spindle 20, it is adapted to be locked against movement relative to the barrel 18 by means of lock stop ball means 57 engaged in diametrically opposite open ended stop sockets 58 in the barrel 18. The balls 57 are adapted to be thrust into selected ones of longitudinally extending locking grooves 59 in the periphery of the spindle by means of a reciprocable lock ring 60 having a cam edged locking shoulder 61 normally driving the locking balls 57 into selected ones of the locking grooves 59. The ring 6 is biased by a compression return spring 62 thrusting at one end against a shoulder 63 on the ring 60 and at its opposite end against a retaining snap ring 64. To release the spindle 20 for rotary adjustment, the lock ring 60 is pulled back against the bias of the spring 62 so that the lock balls 57 release from the lock grooves 59. Then the spindle can be turned to whatever adjustment is desired, and the lock ring 60 released for returning the balls 57 to locking relation to the appropriate lock grooves 59.

It will thus be apparent that the present invention provides for dual torque release load value adjustments attaining accuracy throughout a substantial spring loading range. Such adjustments are substantially improved by a unique reaction coupling of the torque release clutch and the reaction barrel of the instrument. Accuracy of the torque release adjustments are substantially improved and maintained.

It will be understood that variations and modifications may be effected without departing from the spirit and scope of the novel concepts of the present invention.

What is claimed is:

1. An adjustable torque controlling mechanism, comprising, in combination:

a drive shaft having one end portion for driving connection with a member to be driven;

a torque releasable clutch on and about an opposite end portion of said shaft and comprising a first disk fixedly attached to the shaft with a terminal part of said shaft exposed at one side of said fixedly attached disk, and a second disk axially shiftable relative to the opposite side of said first disk;

wear resistant torque sensitive ball detent release means between said disks;

a tubular housing about said shaft including a reaction barrel having a generally cup shaped hand grip member on one end portion of the barrel and enclosing said clutch;

a tubular spindle telescopically shiftable within an opposite end portion of said barrel and having a part projecting from the barrel about said shaft and said driving end portion of the shaft projecting from the projecting part of the spindle;

means on said projecting part of the spindle to facilitate effecting axial adjustments of the spindle relative to the barrel and including torque value calibrations cooperatively related to index means carried by said projecting part of the spindle;

means for fixedly locking said spindle in selectively axially adjusted positions relative to said barrel;

spaced antifriction bearing assemblies rotatably mounting said shaft within said spindle, and one of said bearing assemblies located on an end of said spindle within said barrel and having a bearing race facing in spaced relation toward said second clutch disk;

a compression spring mounted about said shaft and having one end thrusting against said bearing race and an opposite end thrusting against said second disk;

spring rate reaction means coupling said second disk to said barrel; and a calibration thrust screw mounted on said hand grip and having an end connected in axial alignment thrust relation to said terminal part for effecting a range of selective axial adjustments of said shaft in cooperation with the axially adjusted positions of said spindle, for adjusting the compression rate of the spring.

2. A mechanism according to claim 1, wherein said wear resistant torque sensitive ball detent release means comprises matching sockets in the interfaces of the disks, detent balls engaging in said sockets, and the sockets having generally axially elongated walls of a diameter comprising a fraction of the ball sector diameter.

3. A mechanism according to claim 1, wherein said tubular spindle has external threads co-acting with internal threads on said barrel for effecting telescopic shifting of the spindle relative to the barrel, and means for locking said barrel and spindle against unintented relative rotation.

4. A mechansim according to claim 3, wherein said locking means comprises a circumferential series of axially extending grooves on the periphery of the spindle, locking balls located in open ended stop sockets in the barrel, and a locking thrust ring about the barrel and engageable with the balls and adapted for releasably retaining the balls in locking relation in selected one of said grooves and being releasable for releasing the balls for permitting relative rotation of the spindle and barrel.

5. A mechanism according to claim 1, wherein said means to facilitate effecting axial adjustments of the spindle relative to the barrel comprise a ring grip on the projecting portion of the spindle, a tubular element on said projecting portion of the spindle and engaged by said ring grip and carrying said torque value calibrations, and means securing said ring grip and said tubular element to the spindle.

6. A mechanism according to claim 5, including index means carried by said barrel and comprising a thimble fixed to said barrel and cooperatively related to said calibrations on said tubular member.

7. A mechanism according to claim 1, wherein said bearing assembly on said end of said spindle within the barrel comprises ball bearings seated in a rabbet groove in said end and said bearing race having means for maintaining such ball bearings in operative engagement within said rabbet groove.

8. A mechanism according to claim 1, wherein said spring rate reaction means comprises radial arms projecting from said second disk, and openings in an axial tubular extension of said barrel having generally ellipsoidally shaped reaction edges engaged by said arms.

9. A mechanism according to claim 8, wherein shifting of said clutch and thereby said second disk toward the spring and movement of said arms along said edges causes increase in torque release value of the spring, and shifting of said clutch and thereby said second disk away from the spring causes movement of said arms along said edges reducing the torque release value of the spring.

10. A mechanism according to claim 1, wherein said calibration screw end comprises a stablizing boss fitting slidably in a complementary blind and guide bore in said second shaft end, and antifriction means between the tip of said boss and a blind end of said bore.

11. An adjustable torque controlling mechanism, comprising, in combination:

a drive shaft having one end portion for driving connection with a member to be driven;

bearing means associated with said one end portion;

a torque releasable clutch means on an opposite end portion of said shaft;

a tubular housing about said shaft and enclosing said clutch means;

biasing spring means extending between said clutch means and said bearing means and normally thrusting said shaft relative to said housing in a direction away from said one end portion; and thrust screw means acting on said shaft in opposition to said spring means biasing thrust for controlling spring compression rate of said biasing spring.

12. An adjustable torque controlling mechanism, comprising, in combination;

a drive shaft having one end portion for driving connection with a member to be driven;

a torque releasable clutch means on an opposite end portion of said shaft;

a tubular housing about said shaft and enclosing said clutch means;

biasing spring means normally thrusting said shaft relative to said housing in a direction away from said one end;

thrust screw means acting on said shaft in opposition to said spring means biasing thrust for controlling spring compression rate of said biasing spring;

a spindle about said shaft, said spindle providing a thrust shoulder for said spring means; and means for adjusting said spindle for adjusting the spring compression rate in cooperation with said thrust screw means.

13. A mechanism according to claim 11, wherein said housing includes a reaction barrel, and spring rate reaction means coupling said clutch means to said barrel.

14. An adjustable torque controlling mechanism, comprising:

a housing;

a drive shaft within said housing having one end portion for driving connection with a member to be driven and having at an opposite end portion a torque releasable clutch;

biasing means connected between said housing and said clutch;

said clutch comprising a pair of clutch disks, one disk being fixedly attached to said shaft and a second disk having a coupling with said housing;

said disks having matching ball detent sockets in interface surfaces of the disks;

detent balls of larger diameter than said sockets and releasably engaging enter end edges of said sockets; and said sockets having generally axially elongated walls of a generally cylindrical diameter and said edges engaging a ball sector comprising a fraction of the ball diameter providing takeup compensation for wear and thereby maintaining substantial clutch accuracy in spite of wear at said socket edges.

15. An adjustable torque controlling mechanism comprising:

a drive shaft having one end portion for driving connection with a member to be driven;

a housing about said shaft with said one end portion projecting from said housing;

a torque releasable clutch on an end portion of said shaft within said housing;

biasing means thrusting in opposite directions between said clutch and a shoulder carried by said housing;

means for shifting said shaft and thereby said clutch relative to said housing for effecting adjustments of the compression rate of the biasing means;

said clutch including arms projecting radially therefrom and means carried by said housing and having generally ellipsoidally shaped reaction edges within openings in which said arms engage said edges so that axial shifting of the clutch with the shaft and movement of said arms along said ellipsoidal edges is adapted to effect adjustments in spring rate of said biasing means.

16. A method of adjusting torque controlling mechanism which includes a drive shaft having an end projecting from a housing and having means for driving a member to be driven on the projecting end portion of the shaft, a torque releasable clutch on an opposite end portion of the shaft, means biasing the clutch, and means for adjusting the bias of the clutch, and comprising:

adjusting said shaft and thereby the clutch axially within the housing; and adjusting the spring rate of said biasing means by said shifting of the shaft and clutch.

17. A method according to claim 16, which comprises, in effecting said spring rate adjusting moving radial arms on said clutch in engagement with ellipsoidal edges carried by said housing.

18. A method according to claim 16, which comprises operating an adjusting screw axially, related to said shaft for adjusting the shaft axially.

19. A method according to claim 16, which comprises, in effecting said spring rate adjusting moving radial arms on said clutch in engagement with ellipsoidal edges carried by said housing, and operating an adjusting screw axially related to said shaft for adjusting the shaft axially.

* * * * *